United States Patent [19]

Chandler

[11] 4,264,114

[45] Apr. 28, 1981

[54] ELECTRICAL CONNECTOR ASSEMBLY

[75] Inventor: David P. Chandler, Downey, Calif.

[73] Assignee: Mattel, Inc., Hawthorne, Calif.

[21] Appl. No.: 1,232

[22] Filed: Jan. 5, 1979

[51] Int. Cl.[3] ..... H01R 23/68

[52] U.S. Cl. ..... 339/17 LC; 339/184 M

[58] Field of Search ..... 339/17 L, 17 LC, 17 LM, 339/65, 66, 176 MP, 184 M, 17 R, 17 C, 17 D; 361/404–406

[56] References Cited

U.S. PATENT DOCUMENTS

| | | | |
|---|---|---|---|
| 3,399,377 | 8/1968 | Warzecka | 339/176 MP |
| 3,966,290 | 6/1976 | Little et al. | 339/176 MP |
| 4,118,757 | 10/1978 | Rinaldo | 361/404 |
| 4,175,821 | 11/1979 | Hunter | 339/258 R |

FOREIGN PATENT DOCUMENTS

| | | | |
|---|---|---|---|
| 716700 | 8/1965 | Canada | 339/17 C |
| 1590642 | 6/1970 | Fed. Rep. of Germany | 339/17 LC |
| 2300485 | 7/1974 | Fed. Rep. of Germany | 339/176 MP |

*Primary Examiner*—Neil Abrams

*Attorney, Agent, or Firm*—John G. Mesaros; Max E. Shirk; Ronald M. Goldman

[57] ABSTRACT

An electrical connector assembly having an electrical connector with an elongate main body with a socket in one long edge thereof with first and second rows of conductive leads extending outwardly from the opposite long edge, a first row of leads bent 90° to the plane of the edge with the other row of leads being bent angularly with the free ends thereof bent again in parallel relation to the first row of leads, the free ends of both rows being generally parallel for insertion into apertures on a printed circuit board with the main body in adjacent proximate relation to the board with the leads secured to the board adjacent an edge portion, the edge having a width generally equal to the length of the body. A cartridge is provided for use with the connector, the cartridge including a pocket in one end thereof. A connector edge of a second printed circuit board within the cartridge extends partially into the pocket for being received within the socket of the connector with the pocket forming a shroud substantially surrounding the main body of the connector and the edge portion of the first printed circuit board. The connector edge is set off-center for permitting insertion only with the cartridge housing properly aligned relative to the connector body.

5 Claims, 3 Drawing Figures

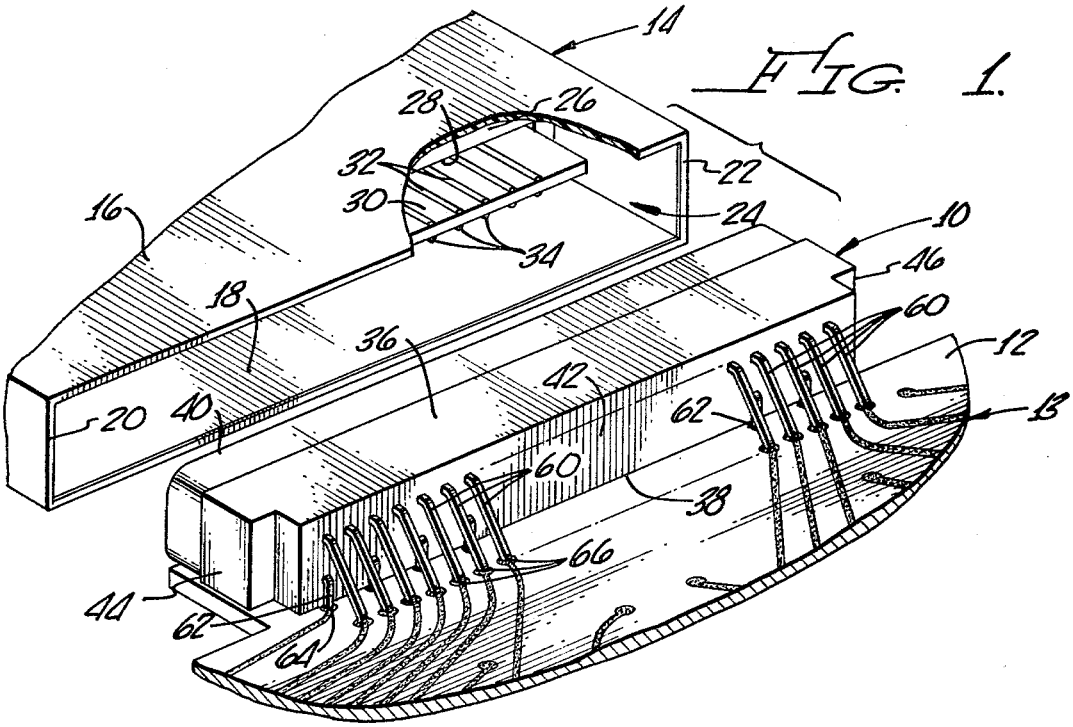
FIG. 1.
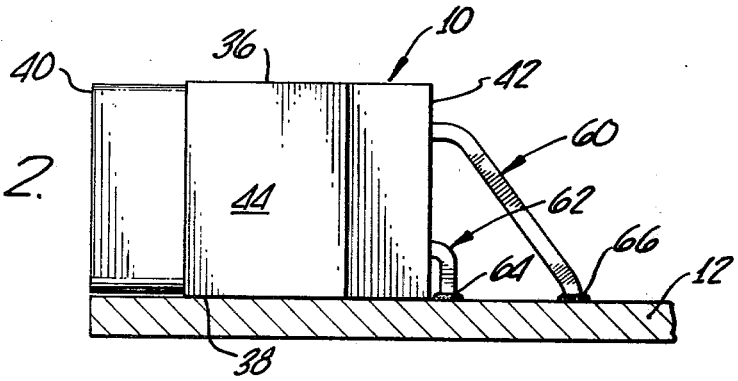
FIG. 2.
FIG. 3.
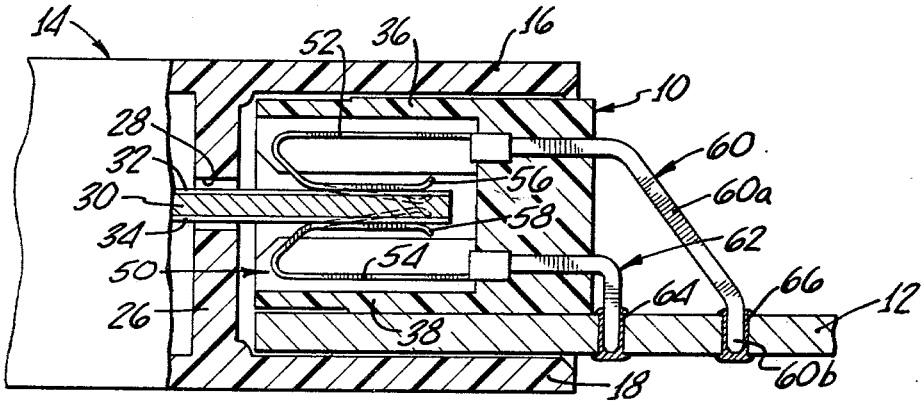

ELECTRICAL CONNECTOR ASSEMBLY

BACKGROUND OF THE INVENTION

The background of the invention will be discussed in two parts:

1. Field of the Invention

This invention relates to electrical connectors, and more particularly to an electrical connector assembly for use with printed circuit boards for providing a connector for securing to a first printed circuit board, the connector having a socket opening for receiving the connector edge of another printed circuit board extending out from a portion of a cartridge housing.

2. Description of the Prior Art

The widespread utilization of printed circuit boards has resulted in the need for electrical connectors which are relatively rigid when secured to the printed circuit board, such electrical connectors generally being provided with mounting lugs or apertures for mechanically connecting the connector to the printed circuit board by fasteners such as nuts and bolts or rivets. This rigid mechanical connection is especially required when the electrical connector is to be used with a plug on another component wherein the component is intended to be repeatedly inserted and removed from the connector.

With the advent of solid state circuitry and integrated circuits, the electrical circuit components have been substantially reduced in size with the overall size limiting factor generally being the mechanical aspects, that is the "packaging" of the components. One typical electrical connector for a printed circuit board is shown and described in U.S. Pat. No. 3,262,082 issued July 19, 1966 to Gammel. That particular connector is provided with holes drilled therethrough for receiving bolts for attaching the connector to a printed circuit board.

It is an object of the present invention to provide a new and improved electrical connector assembly.

It is another object of the present invention to provide a new and improved electrical connector for use with a printed circuit board or the like.

It is still another object of the present invention to provide an electrical connector assembly including an electrical connector for use with a cartridge having a recess or pocket portion with the connector edge of a second printed circuit board extending therein for being received by the socket portion of the connector with the adjacent housing walls of the pocket substantially surrounding the connector and an adjacent end of the first printed circuit board for providing a generally rigid connection.

SUMMARY OF THE INVENTION

The foregoing and other objects of the invention are accomplished by providing an electrical connector having an elongate main body with a socket portion in one long edge thereof with the opposite long edge having first and second rows of aligned generally equally spaced electrically conductive leads extending therefrom, the first row of electrical leads extending 90° to the plane of the edge in close proximate relation therewith with the second row of leads being angularly inclined with the free ends thereof bent parallel to the first row. The free ends of both rows of leads are configured for being received in parallel rows of apertures in a printed circuit board or the like and when so secured forming a truss for supporting the main body of the connector in generally abutting relation with an edge portion of the printed circuit board, the edge portion having a width generally coinciding with the length of the body. A cartridge or the like has the housing thereof configured for forming a recess or pocket in one end thereof, the pocket having partially extending therein from within the housing the connector edge of a second printed circuit board, this edge being positioned off center relative to the height of the pocket to permit insertion of the connector edge into the electrical connector socket with only one orientation of the cartridge housing, that is with the pocket side walls substantially surrounding the main body of the electrical connector and the adjacent printed circuit board edge portion in the direction of insertion.

Other objects, features and advantages of the invention will become apparent from a reading of the specification when taken in conjunction with the drawings in which like reference numerals refer to like elements in the several views.

BRIEF DESCRIPTION OF THE DRAWINGS

FIG. 1 is an exploded perspective view, partially broken away, of the electrical connector assembly according to the invention;

FIG. 2 is an end view of the electrical connector according to the invention in assembled relation with a printed circuit board; and FIG. 3 is a partial cross-sectional view of the electrical connector assembly of FIG. 1 in assembled relation.

DESCRIPTION OF THE PREFERRED EMBODIMENT

Referring now to the drawings and particularly to FIG. 1 there is shown an electrical connector assembly according to the invention including an electrical connector generally designated 10 mounted on a first planiform printed circuit board 12, the lower surface of the connector 10 being in abutting relation with the plane of the printed circuit board 12. In exploded relation therewith, there is shown a portion of a housing or cartridge generally designated 14, the upper and lower walls 16 and 18 thereof along with the opposite sides 20 and 22 being rectangular in form and defining a recess or pocket 24 having an open end with a recessed partition 26 spaced inwardly from the open end thereof. The partition 26 is provided with an elongate slot 28 through which extends the connector edge 30 of a second printed circuit board having components mounted thereon and enclosed within a compartment formed within cartridge 14. The connector edge is generally planar in form and generally rectangular with the opposite edges thereof spaced from the adjacent side walls 20 and 22 respectively.

As is conventional, a printed circuit board connector edge will have an insulating substrate with a plurality of aligned conductive contact strips 32 and 34 formed on the upper and lower surfaces thereof, the contact strips 32 being generally parallel to each other and extending in the direction of insertion. Similarly, the contact strips 34 on the undersurface of the edge 30 are generally parallel to each other and in general alignment in the vertical direction with the contact strip 32 immediately thereabove.

When printed circuit board edge connectors are utilized as plug members for insertion into the socket portion of an electrical connector, if the plug member is connected to a component such as the cartridge 14 which is adapted for repeated insertion and removal from the corresponding electrical connector 10, with an exposed connector edge, the likelihood of damage thereto is great, such as by breakage, deformation, damage from static electricity discharged to component in the cartridge, or the application of body oil to the contact strips 32 and 34, all of these problems resulting in mechanical or electrical problems with the connector edge 30 inserted into the socket of the connector 10.

As illustrated in FIGS. 1 and 3, the leading edge of the connector edge 30 is spaced from and recessed within the opening of the pocket 24 to minimize or eliminate personal contact with the connector edge 30 and to minimize the possibility of breakage or bending of the connector edge 30. Furthermore, keying of the connector edge may be accomplished as in the present invention by positioning the plane of the connector edge 30 off center from a plane parallel to the upper and lower walls 16 and 18 of the cartridge 14. Thus, the plane of the connector edge 30 is generally parallel to the upper and lower walls but at a location off center of the vertical dimension of the pocket 24. The connector edge 30 may likewise be keyed by having the spacing between an end thereof and one of the side walls 20 and 22 different from the spacing at the opposite end. With this latter method, the socket of the connector 10 would have to be correspondingly offset in the same plane.

Referring to FIGS. 1–3, the electrical connector 10 is provided with an elongate main body portion having an upper surface 36 and a lower surface 38 in generally parallel relation with generally perpendicular opposite long edges 40 and 42 at the front and rear thereof respectively relative to the direction of insertion of the cartridge 14. The opposite ends 44 and 46 are generally perpendicular to the upper and lower surfaces 36 and 38 and parallel to each other to define a generally rectangular box-like connector body. As best illustrated in FIG. 3, the front edge 40 is provided with a socket portion generally designated 50, the socket 50 in conventional configuration having a plurality of pairs of upper and lower spring contact members 52 and 54 respectively assembled in opposing pairs with the free ends 56 and 58 thereof in normally closely spaced relation (as shown in dotted lines) until the connector edge 30 is inserted therein, whereupon the upper spring contact member 56 engages an aligned upper contact strip 32 while the lower contact member 58 engages an aligned lower contact strip 34. Each of the upper and lower spring contact members 52 and 54 respectively are electrically connected to conductive leads generally designated 60 and 62 respectively, the leads 60 and 62 being generally bar-shaped in cross-section and extending outwardly of the rear long edge 42 to form two parallel rows of generally aligned conductive leads 60 and 62 (see FIG. 1).

The leads 62 extend downwardly immediately adjacent the surface of the long edge 42 while the leads 60 of the upper row of leads are bent at an angle of approximately 45° to form section **60*a* of lead 60 and thence downwardly to form section 60*b* which is in generally parallel alignment with lead 62. The terminal ends of leads 60 and 62 lie generally in a common plane, and similarly, all of the leads 62 lie in the same plane as do all parts of the portion 60*b* of lead 60 which lie in a plane generally parallel to the plane of leads 62. The printed circuit board 12 is provided with two parallel rows of apertures 64 and 66 for receiving the terminal ends of leads 62 and 60 respectively. Adjacent the surfaces of the apertures 64 and 66, as is conventional with printed circuit board assembly, the upper and/or lower surfaces of board 12 are provided with electrically conductive areas surrounding the apertures, these areas being referred to as pads. With the terminal ends of leads 62 and 60 inserted in the apertures 64 and 66 respectively, the connection is suitably secured by conventional means such as soldering or the like to provide a firm mechanical connection as well as electrical connection. This connection is secured with the undersurface 38 of the main body portion of the connector 10 in generally abutting relation with the adjacent surface of the printed circuit board 12. As illustrated in FIGS. 2 and 3, the front edge of the printed circuit board lies generally along the same line as the plane of the front edge 40 of the connector 10, with the board 12 having an edge portion generally designated 13 configured to the dimension of the plan view of the connector body so that as shown in FIG. 3, with the cartridge 14 inserted into the connector 10 the walls of pocket 24 substantially surround the main body of connector 10 and the edge portion 13**.

The configuration of the leads 60 and 62 relative to each other and relative to the main body portion of the connector 10 provide a triangular or truss-type structure which is mechanically rigid to provide a fastener free connection with the connector 10 secured to the printed circuit board 12 to enable the repeated insertion and removal of the electrical connection of the cartridge 14. Furthermore, with the shroud or pocket configuration and recessed contact edge 30 of cartridge 14, personal contact with the contact strips 32 and 34 of the second printed circuit board connector edge 30 is substantially eliminated. With the edge 30 inserted within the socket 50, as shown in FIG. 3, the pocket 24 of cartridge 14 substantially surrounds the main body portion of the connector 10 along with the abutting edge portion 13 of board 12. The pocket 24 is configured and dimensioned to be in close fitting relation with the upper surface 36 and opposite edges 44 and 46 of connector 10 and with the lower surface of the edge portion 13 of board 12 to provide a substantially rigid connection. Additionally, with the connector edge 30 being off center relative to the lateral midpoint of the pocket 24, the assembly is keyed for one orientation of insertion of the cartridge 14 into the connector 10. With this particular arrangement, mounting lugs or ears extending out from the sides of the main body portion of the connector 10 are eliminated, and correspondingly apertures extending through the connector for mounting are likewise eliminated. By way of illustration, and not of limitation, the dimensions of the particular connector are approximately 2½ inches in length with a height of approximately ⅜ths of an inch with an overall width in the direction of insertion of the cartridge 14 of approximately ¾ of an inch. The spacing between the parallel portions of leads 60 and 62 is in the order of 0.200 of an inch and with the triangular truss-type configuration of the conductor leads when viewed in end view, a rigid mechanical connection is obtained to withstand repeated insertions of the cartridge 10.

While there has been shown and described a preferred embodiment, it is to be understood that various other adaptations and modifications may be made within the spirit and scope of the invention.

What is claimed is:

1. In an electrical connector assembly, the combination comprising:

an electrical connector having an elongate main body portion with an elongate socket opening in one long side thereof and first and second generally parallel planar surfaces on the sides adjacent said socket opening;

first and second generally parallel rows of spaced aligned electrical conductor leads secured to and extending outwardly from the other long side of said body portion, said first row of leads extending generally parallel relative to the plane of said other long side in close proximate relation therewith, and said second row of leads being angularly inclined relative to the plane of said other long side with the terminal ends of said second row of leads having portions thereof parallel to said first row of leads;

a printed circuit board having an edge portion with first and second parallel rows of apertures spaced from the free end of said edge portion, said edge portion having a planar configuration generally identical to one of the parallel surfaces of the electrical connector for abutting engagement in alignment therewith with the terminal ends of said conductor leads electrically secured within said rows of apertures and said one long side of said main body in general flush alignment with the free end of said edge portion, said first and second rows of leads forming a truss support of substantially triangular outline and the only mechanical connection with said printed circuit board;

a cartridge configured for receiving electrical components therein, said cartridge having a pocket with opposing generally parallel walls adjacent one edge thereof; and a generally planar connector edge having contacts thereon for electrically connecting two components within said cartridge, said connector edge extending into said pocket with the free end thereof spaced inwardly from the opening of said pocket, said connector edge and said pocket being configured for insertion of said connector edge into said elongate socket opening with one parallel wall of said pocket in close engaging relation with the surface of said edge portion opposite said connector and the other opposing generally parallel wall of said pocket in close engaging relation to the planar surface of said electrical connector opposite said edge portion, said connector assembly enabling repeated insertion and removal of the connector edge of said cartridge into said socket opening.

2. The combination according to claim 1 wherein each of said conductor leads is substantially identical in cross-sectional configuration.

3. The combination according to claim 2 wherein each of said leads is generally bar-shaped in cross-section.

4. The combination according to claim 1 wherein said connector edge lies in a plane offset from the lateral center of said pocket for enabling insertion of the cartridge in only one orientation.

5. The combination according to claim 4 wherein said connector edge is an integral part of another printed circuit board within said cartridge and opposite side edges thereof are in spaced relation from adjacent surfaces within said pocket.

* * * * *